US009567536B2

(12) United States Patent
Pintar et al.

(10) Patent No.: US 9,567,536 B2
(45) Date of Patent: Feb. 14, 2017

(54) INTEGRATED HYDROTREATING AND SLURRY HYDROCRACKING PROCESS

(71) Applicant: UOP LLC, Des Plaines, IL (US)

(72) Inventors: Daniel J. Pintar, Hoffman Estates, IL (US); Ping Sun, Riverside, IL (US)

(73) Assignee: UOP LLC, Des Plaines, IL (US)

( * ) Notice: Subject to any disclaimer, the term of this patent is extended or adjusted under 35 U.S.C. 154(b) by 162 days.

(21) Appl. No.: 14/531,004

(22) Filed: Nov. 3, 2014

(65) Prior Publication Data

US 2016/0122663 A1 May 5, 2016

(51) Int. Cl.
*C10G 65/12* (2006.01)
*C10G 67/02* (2006.01)

(52) U.S. Cl.
CPC ..... *C10G 65/12* (2013.01); *C10G 67/02* (2013.01)

(58) Field of Classification Search
CPC ..... C10G 65/12
See application file for complete search history.

(56) References Cited

U.S. PATENT DOCUMENTS 5,474,977 A 12/1995 Gatsis
5,755,955 A 5/1998 Benham et al.
6,179,995 B1 1/2001 Cash et al.
7,938,952 B2 5/2011 Colyar et al.
8,277,638 B2 10/2012 Bhattacharyya et al.
2003/0111385 A1* 6/2003 Cash ..... C10G 65/12 208/58
2009/0321313 A1* 12/2009 Mezza ..... C10G 47/04 208/108
2010/0122934 A1 5/2010 Haizmann et al.
2013/0256190 A1* 10/2013 Van Wees ..... C10G 45/58 208/59
2014/0034549 A1 2/2014 Mukherjee et al.

OTHER PUBLICATIONS

Dan Gillis et al "Upgrading Residues to Maximum Distillate Yields"—2009, pp. 1-19.
Dan Gillis et al Upgrading Residues for High Levels of Distillate Production, Petroleum Technology Quarterly, refining Gas Processing Petrochemicals, PTQ, 2009, pp. 59-69.
Robert Haizmann "Maximize Conversion and Flexibility, The UOP Uniflex TM Process", 6th Russia and CIS BBTC Conference, Apr. 13-14, 2011, Moscow, Russia, pp. 1-20.
PCT Search Report dated Mar. 31, 2016 for corresponding PCT Application No. PCT/US2015/058175.

* cited by examiner

*Primary Examiner* — Michelle Stein

(57) ABSTRACT

An integrated slurry hydrocracking process and apparatus are described. The process includes introducing heavy residual hydrocarbon oil and a hydrogen stream into a slurry hydrocracking zone. The hydrocarbon feed is cracked to form a slurry hydrocracking effluent. At least a portion of the shiny hydrocracking effluent is introduced to a distillate hydrotreater along with make-up hydrogen. The slurry hydrocracking effluent is hydrotreated to form a hydrotreated effluent. The hydrotreated effluent is separated into a liquid stream and a gas stream containing hydrogen. The gas stream containing the hydrogen is recycled to the slurry hydrocracking zone forming the hydrogen stream introduced into the slurry hydrocracking zone.

17 Claims, 1 Drawing Sheet

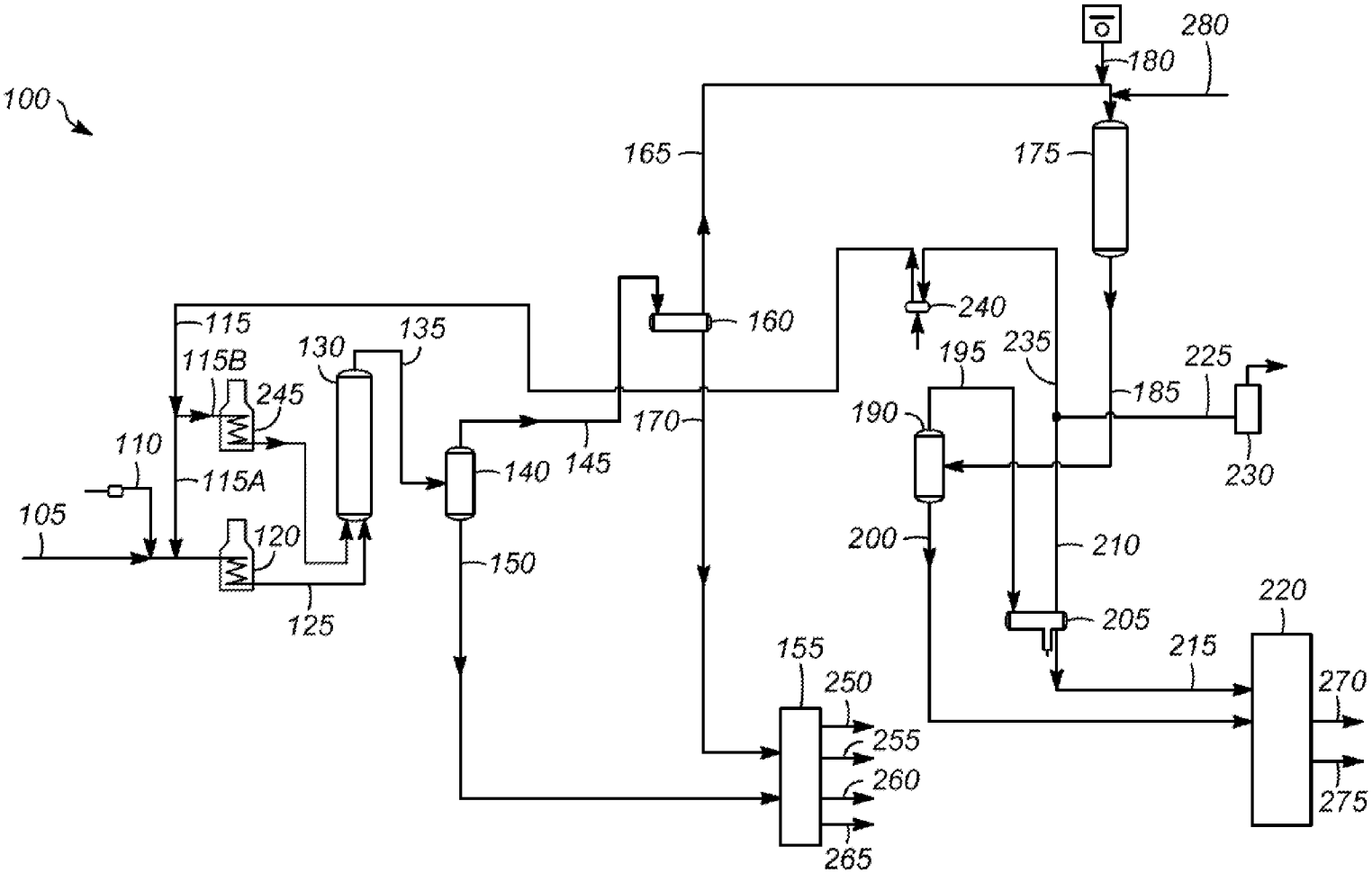
100
105
110
115
115A
115B
120
125
130
135
140
145
150
155
160
165
170
175
180
185
190
195
200
205
210
215
220
225
230
235
240
245
250
255
260
265
270
275
280

INTEGRATED HYDROTREATING AND SLURRY HYDROCRACKING PROCESS

BACKGROUND OF THE INVENTION

Slurry hydrocracking (SHC) is used for the upgrading of heavy hydrocarbon feedstocks to produce distillate products. In SHC, these feedstocks are converted in the presence of hydrogen and solid catalyst particles (e.g., as a particulate metallic compound such as a metal sulfide) in a slurry phase. Representative slurry hydrocracking processes are described, for example, in U.S. Pat. No. 5,755,955 and U.S. Pat. No. 5,474,977.

The distillate products produced using SHC include naphtha, jet fuel, diesel, and vacuum gas oil (VGO) range materials that are high in contaminants such as sulfur, nitrogen, olefins, and aromatics. In order to meet product specifications such as for example, low sulfur, low nitrogen, and cetane, the distillate products need further upgrading by hydrotreating. The hydrotreater is typically a stand-alone distillate hydrotreater to upgrade liquid products. This requires additional capital to construct the hydrotreater, requiring additional compressors, vessels, heat exchangers and the like.

Therefore, there is a need for an improved process for upgrading heavy hydrocarbon feeds.

SUMMARY OF THE INVENTION

One aspect of the invention is an integrated slurry hydrocracking process. In one embodiment, the process includes introducing a heavy residual hydrocarbon feed and a hydrogen stream into a slurry hydrocracking zone. The hydrocarbon feed is subjected to slurry hydrocracking, in the presence of a slurry hydrocracking catalyst under slurry hydrocracking conditions to form a slurry hydrocracking effluent. At least a portion of the slurry hydrocracking effluent is introduced to the first end of a distillate hydrotreater. Make-up hydrogen is introduced at hydrotreater inlet to provide additional high-purity hydrogen. The portion of the slurry hydrocracking effluent is hydrotreated in the distillate hydrotreater under distillate hydrotreating conditions to form a hydrotreated effluent exiting the distillate hydrotreater at a second end opposite the first end. The hydrotreated effluent is separated into a liquid stream and a gas stream containing hydrogen. At least a portion of the gas stream containing the hydrogen is recycled to the slurry hydrocracking zone. The hydrogen stream comprises the at least the portion of the recycled gas stream containing the hydrogen.

Another aspect of the invention is an apparatus for slurry hydrocracking. The apparatus includes a slurry hydrocracking zone having a feed inlet, a hydrogen inlet, and an outlet; at least one separator having an inlet, a vapor outlet, and a liquid outlet the inlet of the at least one separator being in fluid communication with the outlet of the slurry hydrocracking zone; a distillate hydrotreater having a feed inlet and a makeup hydrogen inlet at a first end, and an outlet at a second end opposite the first end, the feed inlet of the distillate hydrotreater being in fluid communication with the vapor outlet of the at least one separator; at least one second separator having an inlet, a vapor outlet, and a liquid outlet, the inlet of the at least one second separator being in fluid communication with the outlet of the distillate hydrotreater, and the vapor outlet of the at least one second separator being, in fluid communication with the inlet of the slurry hydrocracking zone; a fractionation zone having at least one inlet and at least one outlet, the at least one inlet being in fluid communication with at least one of the liquid outlet of the at least one separator, and the liquid outlet of the at least one second separator.

BRIEF DESCRIPTION OF THE DRAWING

The FIGURE illustrates me embodiment of a process of the present invention.

DETAILED DESCRIPTION OF THE INVENTION

The present invention provides an improved process for treating heavy hydrocarbon feeds. The distillate hydrotreater is integrated into the SHC unit by introducing the fresh make-up hydrogen for the SHC unit into the distillate hydrotreater and operating the distillate hydrotreater in a once-through gas mode. The feed to the distillate hydrotreater comes from either the hot or warm separators in the SHC unit. Additional feed can come from fractionators in the process or from an outside source. The effluent from the distillate hydrotreater is sent to one or more separators and a fractionation zone where the products are further fractionated. The off-gas from the distillate hydrotreater separator is directed to the recycle compressor suction of the SHC reaction section, which supplies hydrogen to the SHC unit.

Integrating the distillate hydrotreater into the SHC process reduces the capital cost for the complex by eliminating extra compressors, separators, and heat exchangers.

High purity, fresh hydrogen is supplied to the inlet of the distillate hydrotreater, maximizing the hydrogen partial pressure of the distillate hydrotreater. The higher hydrogen partial pressure at the distillate hydrotreater inlet helps to maximize desulfurization, denitrification, and product properties upgrade.

Because the distillate hydrotreater is operated at high pressure, the once through hydrogen off-gas may be able to be scrubbed and sent downstream to other hydrotreaters in the refinery complex. It could also supply the SHC unit with hydrogen. The make-up hydrogen flow rate for the distillate hydrotreater would be set to supply the hydrogen requirement for the distillate hydrotreater operation along with enough excess to supply the SHC unit's recycle gas hydrogen purity requirement (e.g., about 75% in some embodiments).

By integrating the distillate hydrotreater in this once through hydrogen mode, the distillate hydrotreater could continue to operate if the SHC unit is shut down for maintenance or due to a process upset. The distillate hydrotreater could be isolated from the SHC reactor and continue to run by processing straight run diesel from the crude unit and direct off-gas from the distillate hydrotreater separator back to the suction of the make-up compressor to minimize hydrogen usage during this mode of operation. Alternatively, off-gas from the distillate hydrotreater separator is sent to the recycle gas compressor suction that is further linked to distillate hydrotreater inlet. Other sources of hydrocarbon feed to the distillate hydrotreater could also be used.

The FIGURE illustrates one embodiment of the process 100. The heavy hydrocarbon feed 105 is combined with the SHC catalyst 110. A recycle hydrogen stream 115 may be split into hydrogen stream 115A and 115B. Hydrogen stream 115A may be combined with the heavy hydrocarbon feed 105 is combined with the SHC catalyst 110 and heated in heater 120. The heated stream 125 is introduced into the SHC zone 130. The hydrogen stream 115B may also be heated in heater 245 and sent to the SHC zone 130.

The heavy hydrocarbon feed 105 to the process often comprises a vacuum column residual stream from a distillation column bottoms stream, such as with an initial boiling point from about 524+° C. (975+° F.). Other representative components, as fresh hydrocarbon feeds, that may be included in the heavy hydrocarbon feedstock include gas oils, such as straight-rum gas oils (e.g., vacuum gas oil), recovered by fractional distillation of crude petroleum. Other gas oils produced in refineries include coker gas oil and visbreaker gas oil. In the case of a straight-run vacuum gas oil, the distillation end point is governed by the crude oil vacuum fractionation column and particularly the fractionation temperature cutoff between the vacuum gas oil and vacuum column bottoms split. Thus, refinery gas oil components suitable as fresh hydrocarbon feed components of the heavy hydrocarbon feedstock to the SHC reactor, such as straight-run fractions, often result from crude oil fractionation or distillation operations, while other gas oil components are obtained following one or more hydrocarbon conversion reactions. Whether or not these gas oils are present, the combined heavy hydrocarbon feedstock to the SHC reaction zone can be a mixture of hydrocarbons (i) boiling predominantly in a representative crude oil vacuum column residue range, for example above about 538° C. (1000° F.), and (ii) hydrocarbons boiling in a representative gas oil range, for example from about 343° C. (650° F.) to an end point of about 593° C. (1100° F.), with other representative distillation end points being about 566° C. (1050° F.), about 538° C. (1000° F.), and about 482° C. (900° F.). In this case, components (i) and (ii) of the heavy hydrocarbon feedstock are therefore representative of a crude oil vacuum column residue and asphalt from a solvent deasphalting unit, respectively.

Additional components of the heavy hydrocarbon feed can include residual oils such as a crude oil vacuum distillation column residuum boiling above 566° C. (1050° F.), tars, bitumen, coal oils, and shale oils. Other asphaltene-containing materials such as whole or topped petroleum crude oils including heavy crude oils may also be used as components processed by SHC. In addition to asphaltenes, these thither possible components of the heavy hydrocarbon feedstock, as well as others, generally also contain significant metallic contaminants (e.g., nickel, iron and vanadium), a high content of organic sulfur and nitrogen compounds, and a high Conradson carbon residue. The metals content of such components, for example, may be 100 ppm to 1,000 ppm by weight, the total sulfur content may range from 1% to 7% by weight, and the API gravity may range from about −5° to about 35°. The Conradson carbon residue of such components is generally at least about 5%, and is often from about 10% to about 35% by weight.

The SHC catalyst 110 typically comprises a solid particulate compound of a catalytically active metal, or a metal in elemental form, either alone or supported on a refractory material such as an inorganic metal oxide (e.g., alumina, silica, titania, zirconia, and mixtures thereof). Other suitable refractory materials include carbon, coal, and clays. Zeolites and non-zeolitic molecular sieves are also useful as solid supports. One advantage of using a solid particulate either alone or supported is its ability to act as a "coke getter" or adsorbent of asphaltene precursors that have a tendency to foul process equipment upon precipitation.

Catalytically active metals for use in SHC include those from Group IVB, Group VB, Group VIB, Group VIIB, or Group VIII of the Periodic Table, which are incorporated in the heavy hydrocarbon feedstock in amounts effective for catalyzing desired hydrotreating and/or hydrocracking reactions to provide, for example, lower boiling hydrocarbons that may be fractionated from the SHC effluent as naphtha and/or distillate products in the substantial absence of the solid particulate. Representative metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

In some embodiments, the metal compounds can be formed in situ, as solid particulates, from a catalyst precursor such as a metal sulfate (e.g., iron sulfite monohydrate) that decomposes or reacts in the SHC reaction zone environment, or in a pretreatment step, to form a desired, well-dispersed and catalytically active solid particulate (e.g., as iron sulfide). Precursors also include oil-soluble organometallic compounds containing the catalytically active metal of interest that thermally decompose to form the solid particulate (e.g., iron sulfide) having catalytic activity. Such compounds are generally highly dispersible in the heavy hydrocarbon feedstock and normally convert under pretreatment or SHC reaction zone conditions to the solid particulate that is contained in the slurry effluent. An exemplary in situ solid particulate preparation, involving pretreating, the heavy hydrocarbon feedstock and precursors of the ultimately desired metal compound, is described, for example, in U.S. Pat. No. 5,474,977.

Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina). Bauxite represents a particular precursor in which conversion of iron oxide crystals contained in this mineral provides an iron sulfide catalyst as a solid particulate, where the iron sulfide after conversion is supported on the alumina that is predominantly present in the bauxite precursor.

A slurry formed with the heavy hydrocarbon feed 105 and the SHC catalyst 110 is normally passed upwardly through the SHC zone 130, with the shiny generally having a solid particulate content in the range from about 0.01% to about 10% by weight.

Conditions in the SHC zone 130 generally include a temperature from about 399° C. (750° F.) to about 538° C. (1000° F.), or about 399° C. (750° F.) to about 482° C. (900° F.), or about 421° C. (790° F.) to about 470° C. (878° F.) a pressure from about 3.5 MPa (500 psig) to about 30 MPa (4351 psig), or 10 MPa (1450 psig) to about 24 MPa (3500 psig), and a space velocity from about 0.1 to about 3 volumes of heavy hydrocarbon feedstock per hour per volume of said SHC zone. The catalyst and conditions used in the SHC zone 130 are suitable for upgrading the heavy hydrocarbon feed 105.

The effluent 135 from the SHC zone 130 is separated in, for example, a first hot separator 140, into vapor stream 145 and liquid stream 150. The first hot separator 140 is at a temperature between about 260° C. (500° F.) and 426° C. (800° F.), and preferably at about the pressure of the SHC reactor. The liquid stream 150 is sent to first fractionation zone 155.

The vapor stream 145 is sent to warm separator 160 where it is separated into a second vapor stream 165 and a second liquid stream 170. The warm separator 160 is at a temperature between about 232° C. (450° F.) and 360° C. (680° F.), and a pressure of about the pressure of the SHC reactor. If needed, the warm separator 160 conditions can be adjusted to control feed boiling point going into the distillate hydrotreater 175. The second liquid stream 170 is sent to the first fractionation zone 155.

The second vapor stream 165 is sent to the distillate hydrotreater 175. Makeup hydrogen 180 is introduced into the inlet of the distillate hydrotreater 175. The introduction of the high purity, fresh hydrogen 180 to the inlet of the distillate hydrotreater 175 maximizes the hydrogen partial pressure, helping improve the removal of sulfur, nitrogen, and other contaminants, it also makes up any additional hydrogen requirement in SHC zone. The second vapor stream 165 and the make-up hydrogen 180 can be heated, if needed.

The distillate hydrotreater 175 contains a hydrotreating catalyst (or a combination of hydrotreating catalysts) and is operated at hydrotreating conditions effective to provide a hydrotreating zone effluent having a reduction contaminants, e.g., a sulfur level in a diesel boiling range preferably to about 10 wppm or less. In general, such conditions include a temperature from about 260° C. (500° F.) to about 470° C. (878° F.), or about 315° C. (599° F.) to about 470° C. (878° F.), or about 315° C. (599° F.) to about 438° C. (820° F.), and a pressure of about the pressure of the SHC warm separator, a liquid hourly space velocity of the fresh hydrocarbonaceous feed stock from about 0.1 $hr^{-1}$ to about 2 $hr^{-1}$. Other hydrotreating conditions are also possible depending on the particular feed stocks being treated.

Suitable hydrotreating catalysts are any known conventional hydrotreating catalysts and include those which are comprised of at least one Group VIII metal (preferably iron, cobalt and nickel, more preferably cobalt and/or nickel) and at least one Group VI metal (preferably molybdenum and tungsten) on a high surface area support material, preferably alumina. Other suitable catalysts include zeolitic catalysts, as well as noble metal catalysts where the noble metal is selected from palladium and platinum. It is within the scope of the processes herein that more than one type of catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, and preferably from about 2 to about 25 weight percent. While the above describes some exemplary catalysts, other hydrotreating catalysts may also be used depending on the particular feed stock and the desired effluent quality.

The hydrotreated effluent 185 is sent to a second hot separator 190 where it is separated into a third vapor stream 195 and a third liquid stream 200. The second hot separator 190 is at a temperature between about 176° C. (350° F.) and 343° C. (650° F.), and at and a pressure of about the pressure of the distillate hydrotreater. The third liquid stream 200 is sent to second fractionation zone 220.

The third vapor stream 195 is sent to a cold separator 205 where it is separated into a gas stream containing hydrogen 210 and a fourth liquid stream 215. The cold separator 205 is at a temperature between about 20° C. (68° F.) and 100° C. (212° F.), and at a pressure of about the pressure of the hot separator 190. The fourth liquid stream 215 is sent to second fractionation zone 220.

A portion 225 of the gas stream 210 is sent to purge gas scrubber 230, before being removed from the system. The rest 235 of the gas stream 210 is sent to a gas compressor 240, forming the hydrogen stream 115.

One or more of first and second liquid streams 150, and 170 are fractionated in first fractionation zone 155 into two or more product streams. For example, one or more of naphtha stream 250, diesel stream 255, vacuum gas oil stream 260, and pitch stream 265 can be formed in first fractionation zone 155. One or more of third and fourth liquid streams 200, and 215 are fractionated in second fractionation zone 220 into two or more product streams. For example, hydrotreated naphtha stream 270, and hydrotreated diesel stream 275 can be formed in second fractionation zone 220. One of more light ends streams from first fractionation zone 155 and second fractionation zone 220 can be cleaned, recovered, or reused as a fuel in one or more heaters in a refinery complex. One or more of the product streams can be recovered and sent for further processing.

One or more additional hydrocarbon streams 280 can be sent to the inlet of the distillate hydrotreater 175. The hydrocarbon stream 280 can be a straight run diesel or a distillate stream from the refinery complex that requires hydrotreating. In some embodiments, one or more of the product streams 250 and 260 can be sent as a second hydrocarbon feed 280 to the inlet of the distillate hydrotreater 175 (not shown). An external source of hydrocarbon stream can also be added to feed stream 280. The hydrocarbon stream 280 can be heated before being introduced into the distillate hydrotreater 175, if needed.

By "about" we mean within 10% of the value, or within 5%, or within 1%.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An integrated slurry hydrocracking process comprising:

introducing a heavy residual hydrocarbon feed and a hydrogen stream into a slurry hydrocracking zone;

slurry hydrocracking the hydrocarbon feed in the presence of a slurry hydrocracking catalyst under slurry hydrocracking conditions to form a slurry hydrocracking effluent;

separating the slurry hydrocracking effluent into a first liquid stream and a first vapor stream in a hot separator, separating the first vapor stream into a second liquid stream and a second vapor stream in a warm separator;

introducing makeup hydrogen to a first end of a distillate hydrotreater;

introducing at least a portion of the second vapor stream to the first end of the distillate hydrotreater;

hydrotreating the at least the portion of the second vapor stream in the distillate hydrotreater under distillate hydrotreating conditions to form a hydrotreated effluent exiting the distillate hydrotreater at a second end opposite the first end;

separating the hydrotreated effluent into a liquid stream and a gas stream containing hydrogen;

recycling at least a portion of the gas stream containing the hydrogen to the slurry hydrocracking zone.

2. The process of claim 1 further comprising:

fractionating the hydrotreated liquid stream into at least two product streams.

3. The process of claim 1 further comprising:

fractionating at least one of the first and second liquid streams into at least two fractionated liquid streams.

4. The process of claim 1 further comprising:

introducing at least one additional hydrocarbon stream into the first end of the distillate hydrotreater.

5. The process of claim 4 further comprising:

heating the at least one additional hydrocarbon stream before introducing the at least one additional hydrocarbon stream into the first end of the distillate hydrotreater.

6. The method of claim 1 wherein separating the hydrotreated effluent into a liquid stream and a gas stream containing hydrogen comprises:

separating the hydrotreated effluent into a third liquid stream and a third vapor stream in a second hot separator; and separating the third vapor stream into a fourth liquid stream and the gas stream containing the hydrogen in a cold separator.

7. The process of claim 6 further comprising:

fractionating at least one of the third and fourth liquid streams.

8. The process of claim 1 further comprising:

heating the at least the portion of the recycled gas stream containing the hydrogen before introducing the at least the portion of the recycled gas stream containing the hydrogen into the slurry hydrocracking zone.

9. The process of claim 1 further comprising:

purifying at least a portion of the gas stream containing the hydrogen.

10. The process of claim 1 wherein the slurry hydrocracking conditions include at least one of: a temperature in a range of about 399° C. (750° F.) to about 538° C. (1000° F.), and a pressure in a range of about 3.5 MPa (g) to about 30 MPa (g).

11. The process of claim 1 wherein the distillate hydrotreating conditions include at least one of: a temperature in a range of about 260° C. (500° F.) to about 470° C. (878° F.), and a pressure in a range of about 3.5 MPa (g) to about 30 MPa (g).

12. An integrated slurry hydrocracking process comprising:

introducing a heavy residual hydrocarbon feed and a hydrogen stream into a slurry hydrocracking zone;

slurry hydrocracking the hydrocarbon feed in the presence of a slurry hydrocracking catalyst under slurry hydrocracking conditions to form a slurry hydrocracking effluent;

separating the slurry hydrocracking effluent into a first liquid stream and a first vapor stream in a hot separator;

separating the first vapor stream into a second liquid stream and a second vapor stream in a warm separator;

introducing the second vapor stream to a first end of a distillate hydrotreater;

introducing makeup hydrogen to the first end of the distillate hydrotreater;

hydrotreating the second vapor stream in the distillate hydrotreater under distillate hydrotreating conditions to form a hydrotreated effluent exiting the distillate hydrotreater at a second end opposite the first end;

separating the hydrotreated effluent into a liquid hydrotreated stream and a third vapor stream containing hydrogen in a second hot separator;

separating the third vapor stream into a third liquid stream and a gas stream containing the hydrogen in a cold separator;

fractionating at least one of the first liquid stream, the second liquid stream, the third liquid stream, and the liquid hydrotreated stream into at least two fractionated liquid streams;

recycling at least a portion of the gas stream containing the hydrogen to the slurry hydrocracking zone; and wherein the hydrogen stream comprises the at least the portion of the recycled gas stream containing the hydrogen.

13. The process of claim 12 further comprising:

introducing at least one additional hydrocarbon stream into the first end of the distillate hydrotreater; and optionally heating the at least one additional hydrocarbon stream before introducing the at least one additional hydrocarbon stream into the first end of the hydrotreater.

14. The process of claim 12 further comprising:

heating the at least the portion of the recycled gas stream containing the hydrogen before introducing the at least the portion of the recycled gas stream containing the hydrogen into the slurry hydrocracking zone.

15. The process of claim 12 further comprising:

purifying at least a portion of the gas stream containing the hydrogen.

16. The process of claim 12 wherein the slurry hydrocracking conditions include at least one of: a temperature in a range of about 399° C. (750° F.) to about 538° C. (1000° F.), and a pressure in a range of about 3.5 MPa (g) to about 30 MPa (g).

17. The process of claim 12 wherein the distillate hydrotreating conditions include at least one of: a temperature in a range of about 260° C. (500° F.) to about 470° C. (878° F.), and a pressure in a range of about 3.5 MPa (g) to about 30 MPa (g).

* * * * *